US005549022A

United States Patent [19]

Knox

[11] Patent Number: 5,549,022

[45] Date of Patent: Aug. 27, 1996

[54] CLOSED END BOX LINE WRENCH

[76] Inventor: Bernard J. Knox, 722 Winfield Rd., Cabot, Pa. 16023

[21] Appl. No.: 421,218

[22] Filed: Apr. 13, 1995

[51] Int. Cl.[6] ..... B25B 13/00

[52] U.S. Cl. ..... 81/124.2; 81/124.3

[58] Field of Search ..... 81/124.2, 124.3, 81/124.7, 58.2, DIG. 8, 121.1, 180.1, 185.1, 185.2

[56] References Cited

U.S. PATENT DOCUMENTS

| | | | |
|---|---|---|---|
| 898,997 | 9/1908 | Sprague . | |
| 2,484,492 | 10/1949 | Dingley . | |
| 2,522,428 | 9/1950 | Brunstad . | |
| 2,591,788 | 4/1952 | Day . | |
| 2,656,750 | 10/1953 | Rasco . | |
| 2,715,347 | 8/1955 | Johnson | 81/124.2 |
| 2,727,418 | 12/1955 | Moon . | |
| 3,741,047 | 6/1973 | Kanowsky . | |
| 4,318,315 | 3/1982 | Washburn | 81/124.2 |
| 5,050,463 | 9/1991 | Stielow . | |
| 5,131,300 | 7/1992 | Daniel . | |
| 5,259,276 | 11/1993 | Baron | 81/58.2 |
| 5,339,710 | 8/1994 | Deadmond et al. . | |

FOREIGN PATENT DOCUMENTS

| | | | |
|---|---|---|---|
| 442045 | 9/1974 | U.S.S.R. | 81/121.1 |

*Primary Examiner*—Bruce M. Kisliuk
*Assistant Examiner*—Joni B. Danganan
*Attorney, Agent, or Firm*—Aileen Champion Addessi

[57] ABSTRACT

A closed end box line wrench includes at least one wrench end and a tool body. The wrench end has a hole therethrough sized and adapted to engage an object, such as a nut. The hole is in communication with an opening for enabling the wrench to be positioned on a line, tubing, or the like by sliding the line through the opening and into the hole. The hole of the wrench end has a multi-sided inside periphery, preferably corresponding to an outside periphery of the object, which contacts the object for gripping the object during use of the wrench. The tool body has a protuberance sized and adapted to be disposed within the opening of the wrench end for providing an additional side of the multi-sided inside periphery for contact with the object. The tool body has a hole for receiving a tool, such as a torque-applying tool, for manipulating the wrench during tightening and loosening of the object. To secure the wrench end and the tool body together, the wrench end has a first mating connection engagable with a second mating connection of the tool body. In addition, a spring and ball assembly may be utilized. A plurality of wrench ends, each having a different size and shape hole, are interchangeable with the tool body for allowing utilization of the wrench with numerous sized and shaped objects.

20 Claims, 1 Drawing Sheet

CLOSED END BOX LINE WRENCH

BACKGROUND OF THE INVENTION

The invention relates to wrenches and, more particularly, to a line wrench having an open end for sliding onto a line, a multi-sided hole for engagement with a line nut, and a detachable closure mechanism.

To loosen or tighten a nut positioned on a line or tube, such as in the automotive repair industry, a wrench having an open end, typically referred to as a "line wrench", is used. The open end of the wrench is slid over the line or tubing, enabling the wrench to engage the line nut. A common problem of conventional line wrenches is slippage because the wrench does not make contact on all sides of the line nut. Another problem is the rounding off of the line nut due to the open end and five sided inner jaw design, which allows the open end to expand under heavier loads and does not provide sufficient grip on the nut.

There are several kinds of open end line wrenches. One such device is disclosed in U.S. Pat. No. 2,727,418 issued Dec. 20, 1955 to Moon and entitled "Reinforced Wrench". The wrench includes a head, having an open end and a hole, and an arcuate member for attachment to the head to prevent the spreading of the arms of the head. However, the wrench does not provide for contact with all sides of a nut and under heavy pressure, the arcuate member may become disengaged from the head. Additionally, a different sized head and arcuate member must be manufactured for various sizes of wrenches, increasing the cost of the wrench.

Another wrench is disclosed in U.S. Pat. No. 5,050,463 issued Sep. 24, 1991 to Stielow and entitled "Ratchet Wrench". The wrench includes a nut driver having an opening and detachable wedge portion mounted within the opening. However, sleeve inserts must be used so that the wrench may accommodate various sizes of nuts. Also, the nut driver does not have a hole for engagement with a torque applying tool.

Therefore, what is needed is an apparatus and method for tightening and loosening an object positioned on a line which utilizes a detachable member engagable within an open end of various sized wrenches for providing contact on all sides of an object with an inside periphery of the wrench and which prevents the expansion of the open end of the wrench thereby reducing slippage and rounding off of the edges of the object.

SUMMARY OF THE INVENTION

A wrench includes a wrench end having a hole extending therethrough with a multi-sided inside periphery, and an opening in communication with the hole for forming an open end of the wrench end. The open end has a first mating connection. The wrench further includes a tool body having a hole therethrough and having a protuberance sized and adapted to fit within the opening of the wrench end for forming at least a portion of a side of the multi-sided inside periphery of the wrench end. The tool body has a second mating connection for engagement with the first mating connection. Preferably, the wrench includes a plurality of wrench ends each having a different sized inside periphery and interchangeable with a single tool body for enabling the wrench to be used for a variety of applications.

The wrench may further include the protuberance having a bore at least partially therethrough and a spring and ball assembly positioned within the bore of the protuberance for retaining together the wrench end and the tool body. The tool body may have a wall positioned at an open end of the tool body adjacent to the protuberance for abutting against the wrench end. The wrench end may include a flange positioned at the open end of the wrench end for providing various sizes of the hole.

A method for manipulating an object positioned on a line includes the steps of providing a plurality of wrench ends, each having a different sized inside periphery, engagable with a single tool body for interchanging the wrench ends with the tool body for accommodating various sized objects and disposing one of said wrench ends onto the line by sliding the line through an opening and into a hole in the wrench end. The method further includes the steps of rotating the wrench end about the line for positioning the open end at a desired position, and disposing the object within the hole by sliding the wrench end onto the object. The method further includes inserting a tool body into the opening for enclosing the object within the wrench end and the tool body, and manipulating the wrench end and the tool body for tightening and loosening the object positioned on the line. The method may further include the step of mateably connecting together the wrench end and the tool body for securing together the wrench end and the tool body.

BRIEF DESCRIPTION ON OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
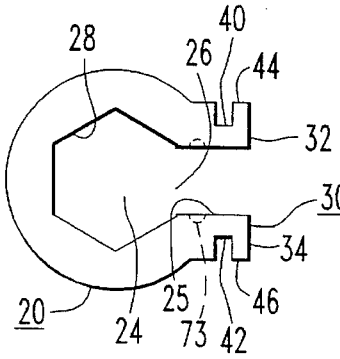
FIG. 1 is a bottom view of a wrench end of a closed end box line wrench.
Figure 2:
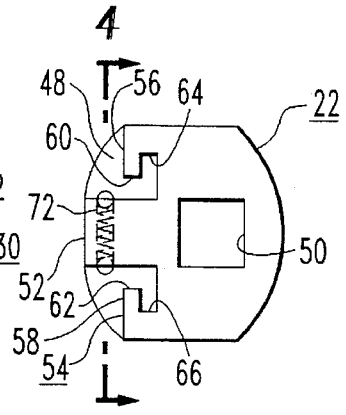
FIG. 2 is a bottom view of a tool body of the closed end box line wrench.
Figure 3:
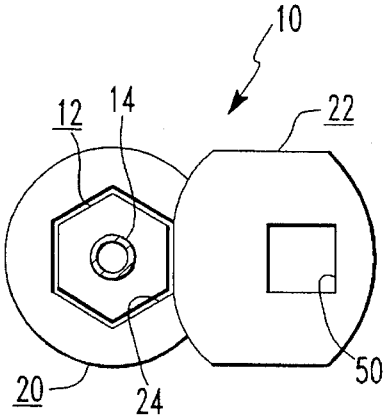
FIG. 3 is a top view of the closed end box line wrench, having the wrench end and the tool body assembled together.

The invention described herein provides an apparatus and method for manipulation of an object positioned on a line.

Referring to FIGS. 1–3 and 7, a closed end box line wrench 10 may be used to tighten and loosen an object 12, such as a line nut, a bolt, a hex nut, or the like, positioned on a line 14, such as a tube, cable, rod or the like. The closed end box line wrench 10 includes a wrench end 20 and a tool body 22. The wrench end 20 has a hole 24 therethrough and an open end 25. The open end 25 has a first arm, a second arm, and an opening 26 positioned therebetween. The opening 26 is in communication with the hole 24 enabling the tube or line 14 to be slid through the opening 26 and into the hole 24. The line nut or other object 12 may be engaged within the hole 24 of the wrench 10.

Preferably, the hole 24 has a six-sided inside periphery 28, the opening 26 forming the sixth side, or alternatively, the opening 26 at least partially forming the sixth side of the inside periphery 28. Alternatively, the hole 24 may have an inside periphery 28 of any shape, such as multi-sided, square, five-sided, or the like, for coupling with various size objects, such as nuts, fasteners, or the like. The outside periphery of the wrench end 20 may be circular, multi-sided, or combinations thereof.

The wrench end 20 has a first mating connection 30 positioned at the open end 25. The first mating connection 30 includes a first coupling member 32 attached to and extending from one side or arm of the open end 25 and a second coupling member 34 attached to and extending from an opposite side or arm of the open end 25. The first and second coupling members 32 and 34 each include a recess 40 and 42 and a knob 44 and 46, respectively, for preventing the disengagement of the wrench end 20 and the tool body 22 during use of the wrench 10. Preferably the attachment of the first and second coupling members 32 and 34 to the open end 25 includes integrally forming the first and second coupling members 32 and 34 with the wrench end 20.

Referring to FIGS. 1–3 and 7, the tool body 22 has an open end 48 and a hole 50 therethrough for receiving a torque-applying tool (not shown) to manipulate the wrench 10 during operation of the wrench 10. The hole 50 may have at least one indentation 51 to retain the torque-applying tool, such as to receive a ball of the tool. Preferably, the hole 50 is square shaped and has one indentation 51 positioned on each side of the square.

The tool body 22 has a protuberance 52, positioned at the open end 48, sized and adapted to fit within the opening 26 of the wrench end 20 for forming a side of the inside periphery 28 of the hole 24 of the wrench end 20. As an example, the protuberance 52 forms the sixth side of the hole 24 for a hexagonally shaped periphery.

Preferably, the inside periphery 28 of the wrench end 20 in combination with the protuberance 52 has a shape corresponding to the outside periphery of the object 12. When the wrench end 20 and the tool body 22 are engaged together and disposed on the object 12, all surfaces of the inside periphery 28 of the wrench end 20 and the protuberance 52 contact all surfaces of the outside periphery of the object 12 providing an effective grip of the wrench 10 on the object 12 by achieving an even distribution of pressure on the object as with a conventional box wrench.

The tool body 22 has a second mating connection 54 for engagement with the first mating connection 30 of the wrench end 20. The second mating connection 54 includes a first coupling member 56 and a second coupling member 58 sized and adapted to engage the first and second coupling members 32 and 34, respectively. The first and second coupling members 56 and 58 each include a knob 60 and 62 and a recess 64 and 66, respectively. The knobs 60 and 62 of the tool body 22 engage with the recesses 40 and 42 of the wrench end 20 and recesses 64 and 66 of the tool body 22 engage with the knobs 44 and 46 of the wrench end 20, for securing together the tool body 22 and the wrench end 20 and preventing disengagement during use of the wrench 10.

The first and second mating connections 30 and 54 provide means for exerting equal and opposite forces to prevent the open end 25, such as the first and second arms of the wrench end 20, from expanding, which would allow the wrench end 20 to slip on the nut or object 12. The first and second coupling members 32, 34, 56 and 58 may have various designs and shapes for providing the opposing forces of the first and second mating connections 30 and 54 and retaining the configuration of the wrench end 20 during use of the wrench 10.

Figure 4:
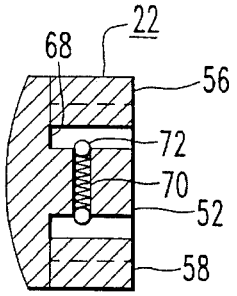
FIG. 4 is a view taken along line 4—4 of FIG. 2.

Referring to FIG. 4, the tool body 22 has a wall 68 positioned adjacent to the protuberance 52 and, preferably, integrally formed with the protuberance 52. The wall 68 provides a means for aligning the wrench end 20 and the tool body 22 and for retaining the wrench end 20 and tool body 22 in an aligned position. During installation of the tool body 22 onto the wrench end 20, the tool body 22 is slid onto the open end 25 of the wrench end 20, enabling the protuberance 52 to be slid within the opening 26 of the wrench end 20, until the first mating connection 30 of the wrench end 20 contacts the wall 68 of the tool body 22.

Referring to FIGS. 1–6, the tool body 22 has a bore 70 positioned in the protuberance 52 for housing a spring and ball assembly 72. The spring and ball assembly 72 retains together the wrench end 20 and the tool body 22. Alternatively, various types of spring and ball assemblies, such as a spring and double ball assembly, or other retention means may be used to detachably hold together the components of the wrench 10. The wrench end 20 may have at least one indentation 73 sized and positioned to receive a portion of a ball being pushed by a spring of the spring and ball assembly 72.

For the various embodiments of this invention, the same reference characters will be used to designate like parts. In addition, like functions and like interactions of the parts among the various embodiments of this invention will not be repeated for each embodiment.

The tool body 22 may be used with various size wrench ends 20 for enabling the closed end box line wrench 10 to be used tier various sizes of objects 12. The wrench 10 includes a single tool body 22 and a plurality of wrench ends 20, each wrench end 20 having an inside periphery 28 with a different size or shape.

Figure 5:
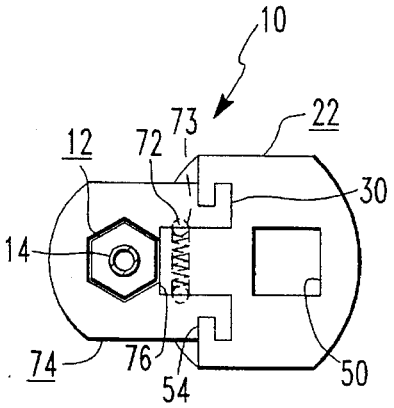
FIG. 5 is a view of an alternative embodiment of the wrench end.

Referring to FIG. 5, as an example, an alternative embodiment of the wrench end 20 may be a wrench end 74 having a flange 76 positioned within the open end 25 and adjacent to the inside periphery 28 of the wrench end 74. The protuberance 52 abuts the flange 76 when the wrench end 74 and the tool body 22 are assembled together. An embodiment similar to FIG. 5 would accommodate nuts or the like having a size smaller than the embodiment illustrated in FIG. 1.

Figure 6:
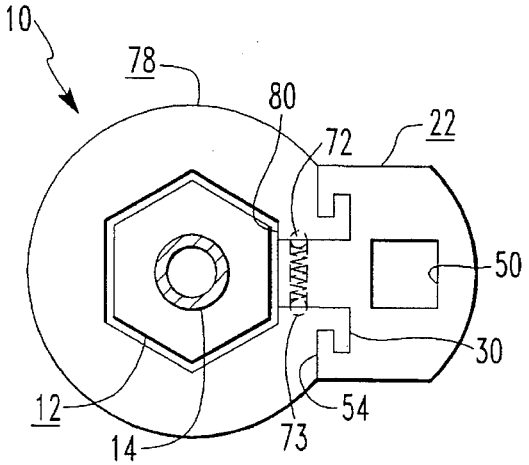
FIG. 6 is a view of another alternative embodiment of the wrench end.
Figure 7:
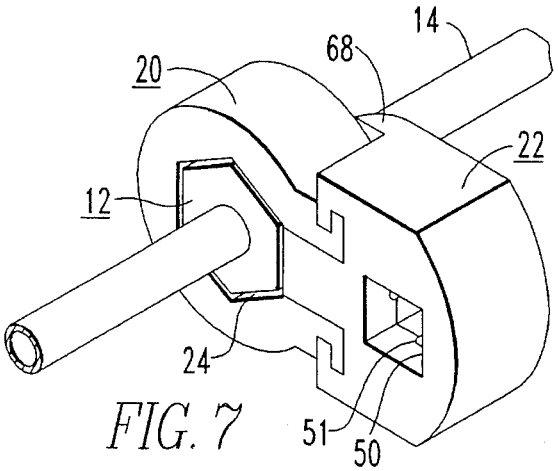
FIG. 7 is a perspective view of the closed end box line wrench.

Referring to FIG. 6, as another example, an alternative embodiment of the wrench end 20 may be a wrench end 78 having a flange 80 positioned within the open end 25 and forming a part of the inside periphery 28 of the wrench end 78, such as the sixth side. The protuberance 52 in combination with the flange 80 form a side of the inside periphery 28 of the wrench end 20. An embodiment similar to FIG. 6 would accommodate nuts or the like having a size larger than a size the embodiment of FIG. 1 illustrates.

To use the closed end box line wrench 10, the wrench end 20 is slid onto a line by passing the line through the open end 25 and into the hole 24 of the wrench end 20. The wrench end 20 may be rotated about the line in a manner so that the open end 25 substantially faces the user of the wrench 10 or to another desired position. The wrench end 20 is then slid onto the object 12 having each side or surface of the inside periphery 28 contact a side or surface of the nut or object 12.

The tool body 22 is slid onto the wrench end 20, engaging the first and second mating connections 30 and 54 and the protuberance 52 within the open end 25 of the wrench end 20. When the wall 68 of the tool body 22 abuts the wrench end 20, the tool body 22 and the wrench end 20 are aligned and the tool body 22 forms at least a portion of a side of the inside periphery 28 of the wrench end 20. The spring and ball assembly 72 contacts the wrench end 20 and helps to retain the tool body 22 and the wrench end 20 together.

A tool, such as a ratchet, breaker bar, various length extensions, or similar torque-applying tool, may be inserted into the hole 50 for rotating the wrench 10 to loosen or tighten the object or nut positioned on the line.

An advantage of the wrench 10 is that the open end design of conventional type wrenches may be utilized without the problem of slippage and rounding off of the nut. The tool body 22 prevents the open end 25 of the wrench 10 from expanding, preventing the open center of the wrench 10 from expanding.

The tool body 22 provides an additional side within the inside periphery of the wrench 10, such as a sixth side, for contacting and gripping the nut during tightening or loosening of the nut. Having all surfaces of the inside periphery contact the nut helps to prevent slippage and rounding off of the nut and provides additional grip to the nut.

The design of the wrench end 20 enables the wrench end 20 to be rotated about the line or tubing for positioning the open end 25 of the wrench end 20 in a convenient location for the user to attach a tool within the hole 50 of the tool body 22, avoiding interference from other items positioned within the proximity of the work area.

Therefore, the invention provides a wrench and method for tightening and loosening an object positioned on a line.

I claim:

1. A wrench, comprising:

a wrench end having a hole extending therethrough with a multi-sided inside periphery and having an opening in communication with said hole for forming an open end of said wrench end, said open end having a first mating connection; and a tool body having a hole therethrough and having a protuberance integrally formed with said tool body sized and adapted to fit within said opening of said wrench end for forming at least a portion of a side of said multi-sided inside periphery of said wrench end, said tool body having a second mating connection engagable with said first mating connection for securing together said wrench end and said tool body, said hole of said tool body being offset from said hole of said wrench end when said wrench end and said tool body are engaged together.

2. The wrench according to claim 1, further comprising a plurality of wrench ends each having a different sized inside periphery and interchangeable with said tool body for enabling said wrench to be used for a variety of applications.

3. The wrench according to claim 1, said wrench end engagable with an object to be manipulated, said object having an outside multi-sided periphery corresponding to said multi-sided inside periphery of said wrench end and said protuberance, wherein said multi-sided inside periphery of said wrench end in combination with said protuberance of said tool body contacts all sides of said outside multi-sided periphery of said object for gripping said object within said wrench.

4. The wrench according to claim 1, further comprising:

said protuberance having a bore at least partially therethrough; and a spring and ball assembly positioned within said bore of said protuberance for retaining together said wrench end and said tool body.

5. The wrench according to claim 1 wherein said tool body has a wall positioned at an open end of the tool body adjacent to said protuberance for abutting against said wrench end.

6. The wrench according to claim 1, wherein said multi-sided inside periphery has a hexagonal shape.

7. The wrench according to claim 1 wherein said first mating connection includes a first coupling member and a second coupling member, each having a knob and a recess, and said second mating connection includes a first coupling member and a second coupling member, each having a knob and a recess, said knobs of said first mating connection engagable with said recesses of said second mating connection and said recesses of said first mating connection engagable with said knobs of said second mating connection for securing together said wrench end and said tool body to prevent expansion of said open end of said wrench end.

8. The wrench according to claim 1, further comprising a flange positioned at said open end of said wrench end and forming a portion of said side of said inside periphery for providing various sizes of said hole.

9. The wrench according to claim 1, further comprising a flange positioned at said open end of said wrench end and abutting said protuberance of said tool body for providing various sizes of said hole.

10. A wrench, comprising:

a tool body having a hole therethrough and having a protuberance integrally formed with said tool body and positioned at an open end of said tool body, said tool body having a second mating connection; and a plurality of wrench ends, each having a hole extending therethrough with a multi-sided inside periphery and having an opening in communication with said hole for forming an open end of said wrench end, said opening sized and adapted to receive said protuberance of said tool body for interchanging a variety of said wrench ends with said tool body, said protuberance forming at least a portion of a side of said multi-sided inside periphery, said open end having a first mating connection sized and positioned to engage said second mating connection of said tool body, said hole of said tool body being offset from said hole of said wrench end when said wrench end and said tool body are engaged together.

11. The wrench according to claim 10, further comprising:

said protuberance having a bore at least partially therethrough; and a spring and ball assembly positioned within said bore of said protuberance for retaining said wrench end onto said tool body.

12. The wrench according to claim 10 wherein said tool body has a wall positioned at an open end of the tool body adjacent to said protuberance for abutting against said wrench end.

13. The wrench according to claim 10 wherein said first mating connection includes a first coupling member and a second coupling member, each having a knob and a recess, and said second mating connection includes a first coupling member and a second coupling member, each having a knob and a recess, said knobs of said first mating connection engagable with said recesses of said second mating connection and said recesses of said first mating connection engagable with said knobs of said second mating connection for securing together said wrench end and said tool body to prevent expansion of said open end of said wrench end.

14. The wrench according to claim 10, said wrench end engagable with an object to be manipulated, said object having an outside periphery corresponding to said multi-sided inside periphery of said wrench end and said side provided by said protuberance, wherein said multi-sided inside periphery of said wrench end in combination with said protuberance of said tool body contacts said outside periphery of said object for gripping said object within said wrench.

15. The wrench according to claim 10, further comprising a flange positioned at said open end of said wrench end for providing various sizes of said hole.

16. The wrench according to claim 10, wherein said tool body includes at least one indentation positioned within said hole.

17. A wrench, comprising:

a wrench end having a hole extending therethrough with a multi-sided inside periphery and having an opening in communication with said hole for forming an open end of said wrench end, said open end having a first mating connection including a first coupling member and a second coupling member, each of said coupling members having a knob and a recess; and a tool body having a hole therethrough and having a protuberance sized and adapted to fit within said opening of said wrench end for forming at least a portion of a side of said multi-sided inside periphery of said wrench end, said tool body having a second mating connection including a first coupling member and a second coupling member, each of said coupling members having a knob and a recess, said knobs of said first mating connection engagable with said recesses of said second mating connection and said recesses of said first mating connection engagable with said knobs of said second mating connection for securing together said wrench end and said tool body to prevent expansion of said open end of said wrench end.

18. The wrench according to claim 17, further comprising a plurality of wrench ends each having a different sized inside periphery and interchangeable with said tool body for enabling said wrench to be used for a variety of applications.

19. The wrench according to claim 17, said wrench end engagable with an object to be manipulated, said object having an outside multi-sided periphery corresponding to said multi-sided inside periphery of said wrench end and said protuberance, wherein said multi-sided inside periphery of said wrench end in combination with said protuberance of said tool body contacts all sides of said outside multi-sided periphery of said object for gripping said object within said wrench.

20. The wrench according to claim 17, further comprising:

said protuberance having a bore at least partially therethrough; and a spring and ball assembly positioned within said bore of said protuberance for retaining together said wrench end and said tool body.

* * * * *